US009695788B2

(12) United States Patent
Moetakef et al.

(10) Patent No.: US 9,695,788 B2
(45) Date of Patent: Jul. 4, 2017

(54) STRUCTURE TO REDUCE NOISE AND VIBRATION IN AN ENGINE SYSTEM

(71) Applicant: Ford Global Technologies, LLC, Dearborn, MI (US)

(72) Inventors: Mohammad Ali Moetakef, West Bloomfield, MI (US); John G. Kilby, New Boston, MI (US); Edward William Peters, Novi, MI (US); Jeff Richard Kosko, Dearborn, MI (US); Abdul Sami Siddiqui, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 98 days.

(21) Appl. No.: 13/719,080

(22) Filed: Dec. 18, 2012

(65) Prior Publication Data

US 2014/0165951 A1 Jun. 19, 2014

(51) Int. Cl.
*F02B 75/06* (2006.01)
*F02M 35/10* (2006.01)
(Continued)

(52) U.S. Cl.
CPC ..... *F02M 35/10321* (2013.01); *F02B 77/13* (2013.01); *F02M 35/10347* (2013.01);
(Continued)

(58) Field of Classification Search
CPC ... F02B 75/06; F02B 77/13; F02M 35/10321; F02M 35/12; F02M 35/10347;
(Continued)

(56) References Cited

U.S. PATENT DOCUMENTS 4,373,608 A 2/1983 Holmes
4,395,982 A * 8/1983 Moller ..... F01M 11/0004 123/195 C
(Continued)

FOREIGN PATENT DOCUMENTS

CN 201532760 U 7/2010
EP 1744302 A2 7/2006

*Primary Examiner* — Lindsay Low
*Assistant Examiner* — Omar Morales
(74) *Attorney, Agent, or Firm* — James Dottavio; McCoy Russell LLP

(57) ABSTRACT

Adding dome-shaped protuberances, or polydomes, to an engine system increases the structural integrity of the engine component to which they are added and allows noise radiated in the engine system to be reduced in certain regions of the frequency spectrum without incurring a significant increase in the mass of the engine part to which they are added, which may result in a longer solidification time during the mold injection process. The size and spatial arrangement of polydomes relative to one another can be further adjusted to reduce noise within the engine system and polydomes may be reinforced with ribs to increase the structural stiffness of plastic engine components. Because plastic engine components are created using an injection mold process during the manufacturing process, added surface features (e.g. polydomes and ribs) are continuous with the underlying planar surface to which they are added.

15 Claims, 13 Drawing Sheets

(51) Int. Cl.

| | |
|---|---|
| ***F02M 35/112*** | (2006.01) |
| ***F02M 35/12*** | (2006.01) |
| ***F02B 77/13*** | (2006.01) |
| *F01N 13/10* | (2010.01) |

(52) U.S. Cl.
CPC ..... *F02M 35/112* (2013.01); *F02M 35/1277* (2013.01); *F01N 13/10* (2013.01); *F01N 2260/20* (2013.01)

(58) Field of Classification Search
CPC . F02M 35/1272; F01N 2260/20; F01N 13/10; F01N 13/16; F01N 2510/04
USPC ..... 123/192.1, 198 E, 184.61, 195 C
See application file for complete search history.

(56) References Cited

U.S. PATENT DOCUMENTS

| | | | | |
|---|---|---|---|---|
| 6,555,246 | B1 * | 4/2003 | Zwick | F01N 13/14 181/290 |
| 7,770,693 | B2 * | 8/2010 | Uejima | 181/294 |
| 2006/0201470 | A1 * | 9/2006 | Vichinsky | 123/184.61 |
| 2007/0014418 | A1 | 1/2007 | Eatwell et al. | |
| 2010/0192902 | A1 * | 8/2010 | Koyama | F02F 7/0073 123/198 E |
| 2010/0326395 | A1 * | 12/2010 | Lohr | F02M 35/10045 123/198 E |

* cited by examiner

STRUCTURE TO REDUCE NOISE AND VIBRATION IN AN ENGINE SYSTEM

FIELD

The present description relates to reducing the noise in an internal combustion engine.

BACKGROUND AND SUMMARY

Internal combustion engines have an air intake system that directs ambient air to the combustion cylinders. Since the tubular shapes of air induction systems may be complex, the flow of air through the system may develop chaotic features that affect how the fluid interacts with the surface of the tube through which it flows. For instance, airflow through a composite intake manifold may develop pressure fluctuations within the cavity and introduce turbulent features into the airflow pattern in a manner that depends on the shape of the cavity. The turbulence induced may then affect how the air transfers its energy to the surface and in response, vibrations may develop in the walls that produce sound radiations in certain regions of the frequency spectrum. The vibrational modes and sound frequencies may further depend on the geometric arrangement of the tube and the velocity of air flow past the surface. Sound radiated from the surface may be considered undesirable noise.

Some approaches aimed at reducing turbulent noise in the engine manifold system involve increasing the structural rigidity of the manifold assembly by adding ribs to the outside of the manifold. Added ribbing stiffens the structure and thereby reduces vibrations in the engine system. US 2010/0326395 A1 shows an example system having ribs and braces added to the outside surface of an intake manifold cover in order to stiffen the assembly and reduce noise from vibrations within the system. An alternative approach to reducing vibrations within a system, and therefore the noise transmitted, involves adding a thin layer of absorbent material to the walls of an engine component. In US 2006/0201470 A1, a system is described wherein two walls of an engine component, e.g. an engine cover or manifold wall, is reinforced with a honeycomb layer of absorbent padding. In the three-layer system described, wherein the absorbent honeycomb layer is sandwiched between two walls, the middle layer also contains a substantial amount of air and so acts as a noise insulator to reduce vibrations and the noise transmitted.

The inventors herein have recognized the above issues, as well as limitations related to such approaches. For example, addition of structural ribs to an engine component, for instance, an intake manifold, may also increase its weight, manufacturing cost, and overall size due to the traversal of the ribs spanning various surfaces. For example, additional structural ribs may increase the manifold outside its allotted package space. Further, such additional features may slow the rate of production. For example, a plastic intake manifold made using the injection mold process may have an increased solidification time, herein referred to as the time-to-freeze. The additional thickness due to additional ribs can thus increase the time-to-freeze and slow production cycle times.

In one example approach to at least partially address these issues, an engine component with a surface, such as a plastic surface, may include a plurality of polydomal protuberances cooperating together to reduce noise and vibration. One advantage of such polydome protuberances is that the polydomes may be added in order to increase the stiffness of the engine part while limiting the increase in overall mass/size and thickness. For example, an increase in mass from addition of polydome features to a surface may be counteracted by a corresponding reduction in, for example, the thickness of the surface to which the polydomes are attached. In this way, it is possible to take advantage of the morphological features described herein to stiffen plastic materials and thereby enhance the sound qualities of the surface with respect to noise reduction. Various embodiments of polydome implementation are described with respect to size, positioning, etc. on a surface of an example engine intake manifold.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF DRAWINGS

FIGS. 2-12 are drawn to scale, although other relative dimensions may be used.

DETAILED DESCRIPTION

Figure 1:
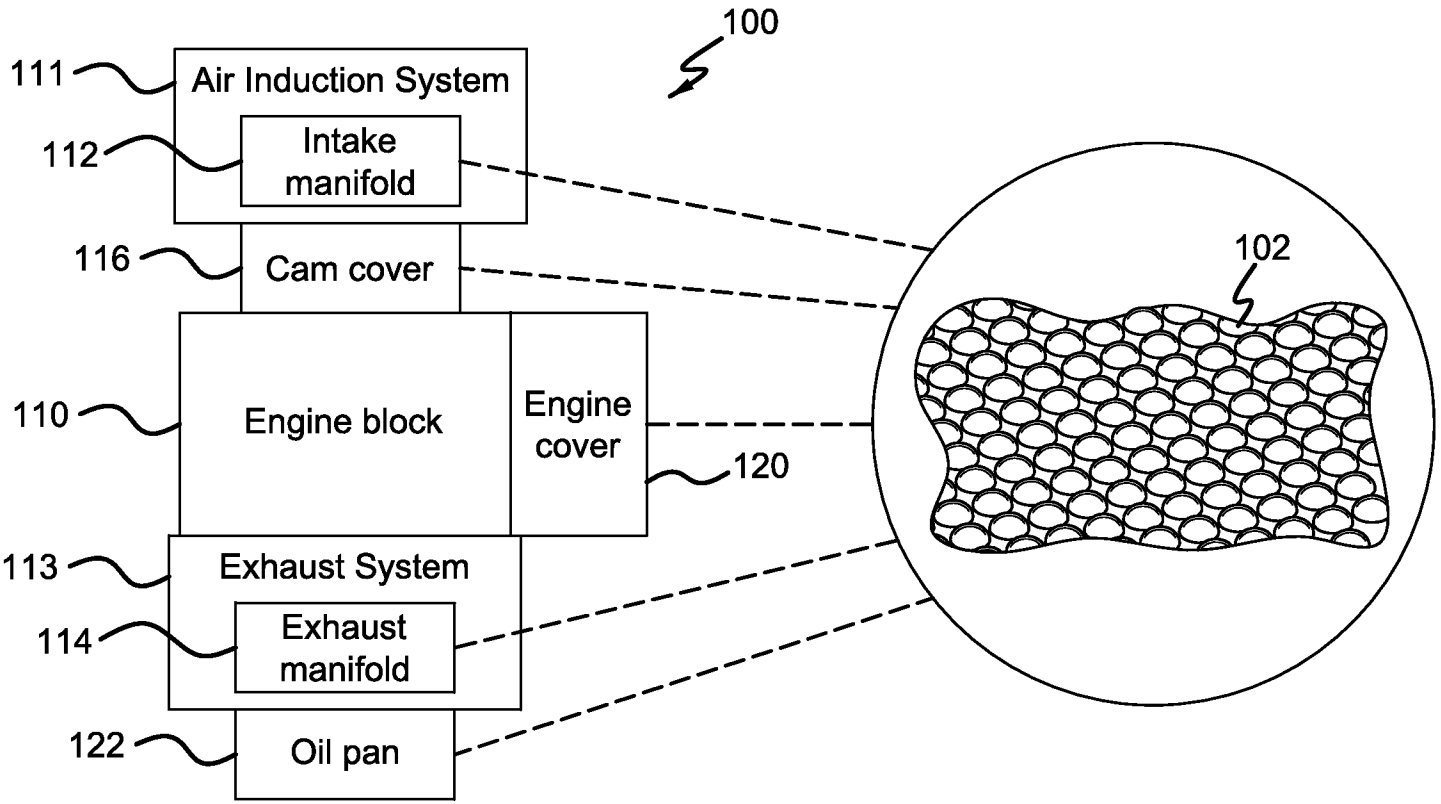
FIG. 1 shows a schematic diagram of an example engine system with example plastic components having planar surfaces identified.

Methods are described for reducing noise radiated in an engine system. In one example, polydome protuberances on planar surfaces of an intake manifold are positioned in a grid-like manner to increase the structural rigidity of the surface and thereby reduce the noise radiated due to vibrations on the surface. However, other engine components and devices may take advantage of such protuberances, such as a cam cover, a front cover, etc. In this regard, FIG. 1 presents a schematic diagram showing example engine components having planar surfaces wherein the described polydome protuberances may be applicable. FIGS. 2-4 show example surfaces with dome-shaped protuberances whose dimensions and spatial arrangements are adjusted to reduce noise in various frequency ranges. The polydomal features offer various advantages, including improving overall packaging space, wall thickness, weight, time-to-freeze, etc. FIGS. 5-12 shows an exemplary intake manifold including example polydome protuberances and ribbing to provide increased structural stiffness of the assembly with reduced radiated noise.

FIG. 1 shows a schematic diagram of example engine system 100. Within the context of the present disclosure, the engine system encompasses diesel engines, spark-ignition engines and also hybrid internal combustion engines. FIG. 1 shows example engine plastic components, each of which optionally including surfaces having polydome protuberances 102. Protuberances 102 may be positioned on various portions of the components, such as throughout planar or substantially planar (e.g., flat enough to accommodate a plurality of polydome protuberances such that the curvature of the surface is less than the curvature of the polydomes) regions to increase the structural rigidity and reduce noise.

In one example, engine system 100 is positioned in a vehicle, such as an on-road vehicle. Various plastic components of the engine system, for example, the intake manifold and head covers, may emit noise that can be heard by the vehicle's driver and passengers. In some cases, the plastic parts may even amplify vibrations to increase the sound level of the noise within the engine system. Sounds radiated may be associated with a certain region of the frequency spectrum, or they may be broadly associated with the entire frequency range, for instance, as white noise. For example, in some engines, pressure fluctuations from turbulence within the air induction system have been identified as the cause of a high-frequency shell noise emanating from the engine system. The high-frequency noise may be reduced via the polydome protuberances described herein.

Referring now to FIG. 1, engine system 100 contains cylinder block 110. The cylinder block and head is a unit comprising at least one cylinder, including cylinder walls, combustion chambers, piston heads connected to a crankshaft, and poppet valves connected to camshaft. It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types.

Air is delivered to engine block 110 through the air induction system 111. The air induction system may include intake manifold 112 and may include a compressor of a turbocharger to increase the pressure of intake air. The intake manifold 112 may be a composite material having a plurality of sub-assemblies, each manufactured by an injection mold process.

During the engine drive cycle, intake and exhaust valves reciprocate in coordination with the cycles of the engine. The valves may be oiled via the engine lubrication system, and covered via plastic cam covers 116. These valve covers may protect multiple cylinders and so may present a relatively large, smooth surface capable of producing vibrational noise within the engine system. As such, valve cover 116 may include a planar surface including polydomes such as described herein.

Engine block 110 is further coupled to an exhaust system 113 that may collect exhaust gases from multiple cylinders into an exhaust pipe and transport the mixture from the cylinders inside the engine block to the atmosphere outside of the vehicle. The exhaust manifold is shown at 114. Although this system may contain more components than described herein, manifold pipes generally transport flowing gases in the same manner described above with respect to intake manifold 112 and so are subject to pressure fluctuations and turbulence therein. Exhaust manifold 114 may contain smooth planar surfaces optionally polydome protuberances to address noise related issues.

Shown at 120 is an engine cover, such as a front end cover, that may be securely attached to engine block 110. The engine cover may be securely attached using, for instance, a set of connector screws or plastic or metal clips. Because of its size relative to the engine, it may also contain relatively large planar surface areas optionally including the polydome protuberances described herein.

The crankcase of engine system 100 may be connected to oil pan 122 through a bolted joint. Oil pan 122 may provide structural support to the engine system and so be rigidly cast and reinforced by ribs. Based on the methods described herein, the ribs may be replaced or supplemented by polydome protuberances in order to reduce sounds radiated within the engine system.

Note that any of the various components described above as optionally including polydomal protuberances may include protuberances according to each of the various examples described in FIGS. 2-4, including combinations thereof. Further, any of the various components described above as optionally including polydomal protuberances may include protuberances such as shown and described in the example intake manifold of FIGS. 5-12.

Figure 2B:
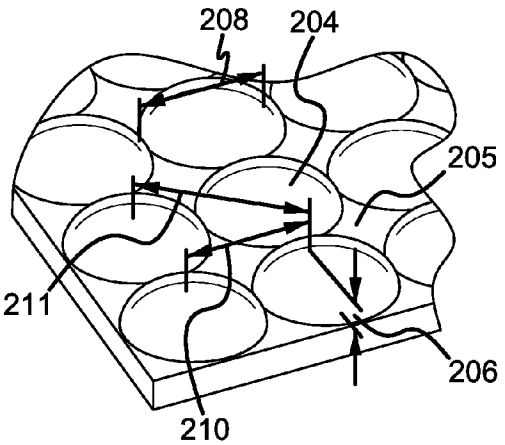
FIGS. 2A-2D show example diagrams of repeating polydome protuberances projecting out from one side of a planar surface in the perpendicular and offset alignments.
Figure 2D:
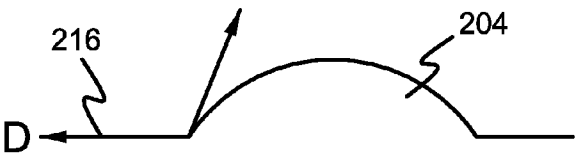
Figure 2A:
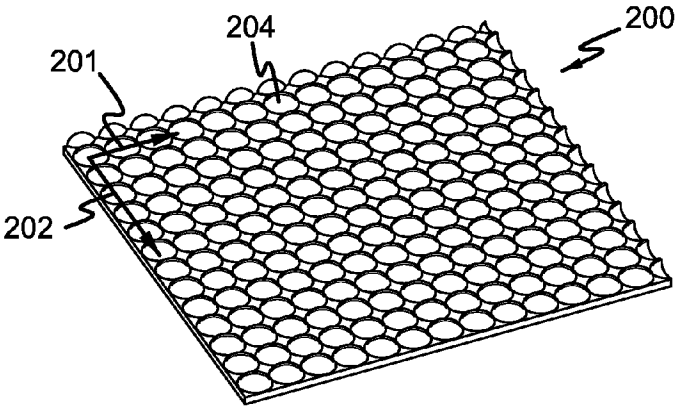
Figure 2C:
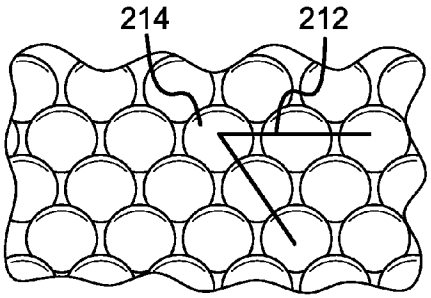

FIGS. 2A and 2C show example surfaces that may be surfaces of component 112, 114, 116, 120, 122 or another engine component on the block, in the intake system, or in the exhaust system, for example. FIG. 2A shows a grid 200 of polydomal protuberances 204 including a plurality of arrays 201 and 202 in an x-y pattern, with the arrays arranged at 90 degrees (±5 degrees), herein 90°, with respect to one another. In this example, in the grid, each polydome in an internal portion of the grid is surrounded by and contiguous with four polydomes arranged at 90° around a central polydome. Each of the four surrounding polydomes is further surrounded by four contiguous polydomes also arranged at 90° in the same manner. FIG. 2B is a zoomed-in view of the square arrangement showing that the distance from a central polydome to the four surrounding polydomes, for example distance 210, is less than the distance from the central polydome to the polydomes at the corners of the square, for example distance 211. Protuberances along the diagonal are therefore separated and contain a gap identified at 205.

In some instances other array alignments may be implemented by, for example, adjusting the alignment of arrays 201 to have an angle other than 90° with respect to one another. For example, in FIG. 2C, the arrays are shown having an angle of 60° (±5°) with respect to one another at 212. This results in an alignment wherein central polydome 214 is surrounded by and contiguous with six polydomes in a hexagonal arrangement. Other angles between arrays are possible and result in an offset alignment wherein polydomes in successive rows are offset with respect to contiguous polydomes of the previous row.

FIG. 2D shows an example vertical cross-section through polydome 204 wherein protuberances intersect the planar surface at angles between 90° and 180° so the shape of a protuberance is less than hemispherical. For example, in the cross-sectional view of FIG. 2D two vectors are included and create angle 216. The first vector is parallel to and lies in the surface of the plane. The second vector represents a line tangent to the surface at a point where the dome intersects the planar surface. When angle 216 is between 90° and 180°, protuberances are less than hemispherical. However, other configurations may be used and the polydomes may be substantially hemispherical (e.g. angle 216 substantially equal to 90°) or they may be more than hemispherical and intersect the planar surface at angles between 0° and 90° in some instances. In a plane parallel to the surface, polydomes have a substantially circular cross-section (e.g. within 5% of circular, or the ratio of the length of the minor axis of an ellipse to the length of the major axis within 5% of unity), but other examples could be used, for instance, polydomes could be elliptical or rectangular in some instances.

Returning to FIG. 2B, the height of a polydome is shown at 206. Because the example polydomes shown are less than hemispherical, the height 206 is less than the radius of a protuberance. However, in some instances, for example, if the protuberances are hemispherical, the height of a protuberance may be substantially equal to the radius of the protuberance.

The distance between adjacent polydome centers is shown at 210. When proximal polydomes abut, as shown in the figure, distance 210 is directly related to the radius (or diameter shown at 208) of the individual polydomes. However, in some embodiments, polydomes may include spacing so adjacent protuberances are separated from each other and therefore not in direct contact. Further still, in some embodiments, the diameter of the polydomal surface protuberances may vary across a region of the surface. In FIG. 2B, the polydomes are shown having a uniform diameter 208 with height 206 smaller than the radius so each polydome has a broad, shallow appearance.

The backside of planar sheet 200 may be a flat surface, or in some embodiments, it may have indentations where polydome protuberances exist. When indentations are included on the backside of the surface, a relatively constant surface thickness may result.

One advantage of including polydome protuberances on the plastic surface is that their inclusion can increase the stiffness of the engine part and thereby reduce noise in a manner that maintains the weight of an engine component. The approach also allows the thickness of an engine part and freeze time to be maintained. For example, in one embodiment, inclusion of polydomes on a surface may increase the mass of the engine component. In another embodiment, the mass of the engine component may be maintained by including polydomes while also decreasing the thickness of the planar surface and, for instance, including indentations on the backside surface. Therefore, engine component parameters, for instance, polydome size and surface thickness, may be varied based on design parameters.

With reference to the surface in FIGS. 2A-D, FIG. 3A shows an example surface 300 reinforced by ribs that may also be a surface of component 112, 114, 116, 120, 122 or another engine component on the block, in the intake system, or in the exhaust system, for example. The figure shows a grid 300 of polydomal protuberances 304 including a plurality of arrays in an x-y pattern as shown at 201 and 202 above. In the example grid, the arrays are again arranged at 90° with respect to one another while each polydome is surrounded by and contiguous with four polydomes arranged at 90° around a central polydome. In the example shown, the polydomes are less than hemispherical, and intersect the planar surface at angles between 90 and 180°. However, other configurations may be used and the polydomes may be hemispherical or they may be more than hemispherical and intersect the planar surface at angles between 0 and 90° in some instances. As described above, polydomes have a circular cross-section in a plane parallel to the surface, but other examples could be used, for instance, elliptical or rectangular.

Figure 3A:
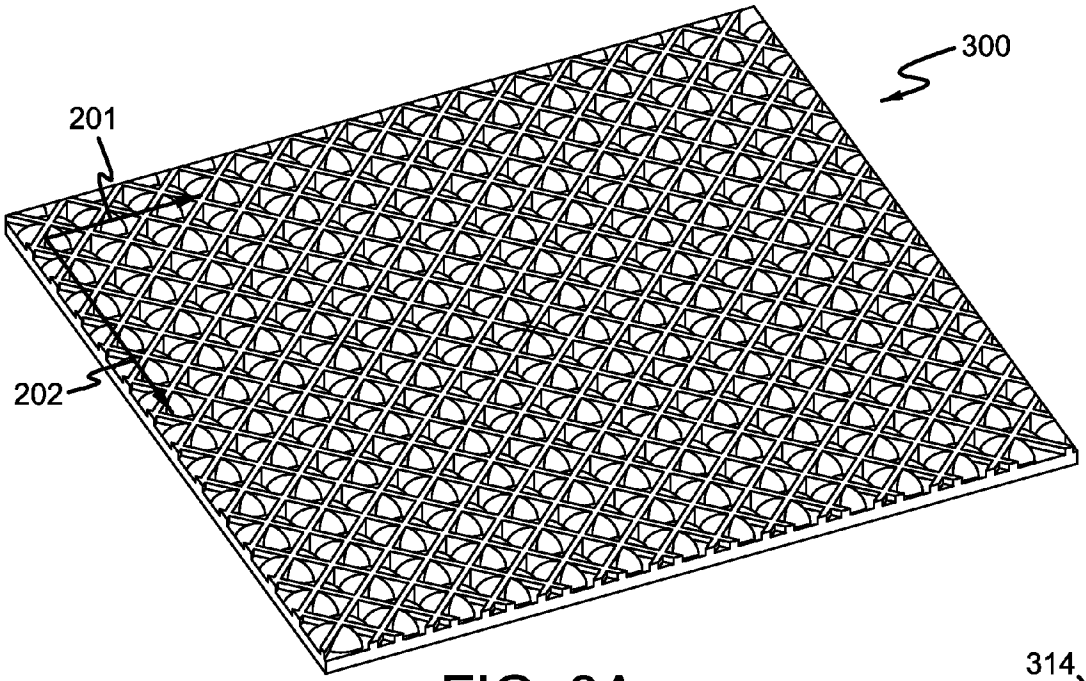
FIGS. 3A and 3B show example diagrams of polydome protuberances projecting out from one side of a planar surface reinforced with ribbing.
Figure 3B:
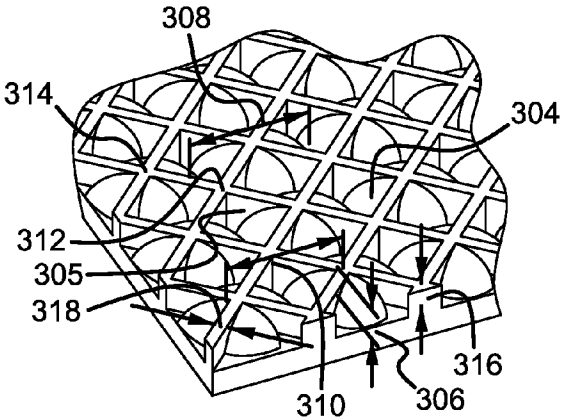

In FIG. 3B, polydomes of the example square arrangement described in FIGS. 2A and 2B are shown connected by ribs 312 along the diagonals. While ribs act to reinforce and strengthen the surface, addition of protuberances to ribs further strengthens the structure by adding curvature that increases the rigidity or stiffness. For instance, addition of protuberances and ribs to the surface as shown in FIGS. 3A and 3B adds transverse support to the ribs by connecting the ribs to the surface through a periodic arrangement of protuberances that connect rib surfaces perpendicular to the planar surface to the planar surface. Inclusion of ribs with protuberances offers advantages over the ribs alone since the ribs may simply contact the planar surface with no transverse support via a contact area substantially equivalent to the length of a rib and its thickness, for example, rib thickness 318. In FIG. 3B, exemplary cross-linked ribs are shown wherein each polydome couples the intersecting ribs to the planar surface in a pocket (described below) by mutually connecting two perpendicular rib faces to the planar surface. For instance, polydome 304 connects the two perpendicular ribs to which it is in contact to the planar surface.

Because perpendicular ribs are shown with a cross-linked arrangement, two types of rib intersections are present. For instance, the ribs may intersect in a gap, for example, gap 205 of FIG. 2B, between polydome protuberances as shown at 312; or the rib intersection may substantially meet tangentially with a peak of the protuberance as shown at 314. In another embodiment, a central polydome protuberance may be connected to the protuberances directly adjacent to it through ribs so the cross-linked grid aligns with the example arrays 201 and 202 of the x-y pattern above. In yet another embodiment, the ribs may be asymmetrically included in one direction or the other so no cross-linking is present on the surface but polydome protuberances are still reinforced by ribs. Further, ribs oriented in more than two directions may be optionally included and interconnected. For instance, in example surface 300, ribs may also be included and oriented parallel to array 202. In such a case, three sets of ribs may intersect at a central polydome, e.g. polydome 304. Although rib intersections are shown distributed uniformly throughout the grid, rib intersections may not be distributed uniformly. For example, various regions may include differing numbers of interconnected ribs compared to other regions. Although ribs are shown perpendicular in the example figures, in some instances, the ribs may not intersect at angles substantially equal to 90°. For example, if ribs were included in FIG. 2B that aligned with lines 210 and 211, their angle of intersection at the central polydome would be substantially equal to 45°.

In the example shown, pockets at 305 result from inclusion of the cross-linked ribs. The pockets correspond to areas on the surface enclosed by ribs on all sides. In the example surface, each pocket contains two opposing corners where the ribs intersect the planar surface at an angle of 90°, and two opposing corners where the ribs intersect the peak of a protuberance dome.

An example rib height is identified at 316. Although the ribs shown have a constant height, the rib height may not be constant throughout. For instance, in one embodiment described below, wherein polydome protuberances are included on both sides of the surface along with indentations on each side, ribbed structures appear to undulate in phase with the wavy surface so the rib heights appear constant relative to the wavy surface. Conversely, in another embodiment, the ribbed structures may have a constant height relative to the planar surface instead of the undulating surface and so appear to have a variable height compared to the undulating surface. In the example surface shown in the figure, the rib height at 316 is substantially similar to dome height 306 (e.g. within 5%). However, in some instances, the heights of the ribs and domes may also be substantially different.

The distance between adjacent polydome centers is shown at 310 (a polydome diameter is shown at 308). Because the example polydomes are less than hemispherical, the height 306 is less than the radius of a polydome. However, in some instances, for example, if the protuberances are hemispherical, the height of a protuberance may be substantially equal to the radius of the protuberance. Further, in some embodiments, polydomes may include spacing so adjacent protuberances are separated from each other and therefore not in direct contact. In FIG. 3B, the height 306 of polydome 304 is smaller than the radius so the polydomes appear broad and shallow.

The backside of planar sheet 300 may be flat, or in some embodiments, it may have indentations that substantially coincide with the locations of polydome protuberances. When indentations are included on the backside of the surface, the thickness of the surface may be relatively constant.

The advantage of reinforcing polydome protuberances with ribbing is that their inclusion can increase the stiffness of the engine part and thereby reduce noise in a manner that maintains the weight of an engine component. Therefore, engine component parameters, for instance, polydome size and rib thickness, may be varied based on design parameters.

Figure 4A:
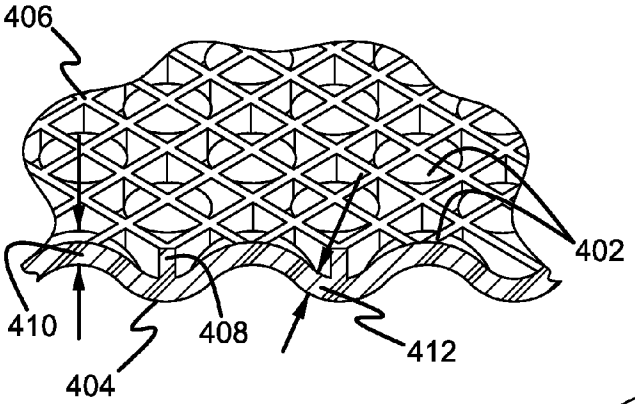
FIGS. 4A-4C show example diagrams of the undulating cross-section created by polydome protuberances projecting out from two sides of a planar surface.
Figure 4B:
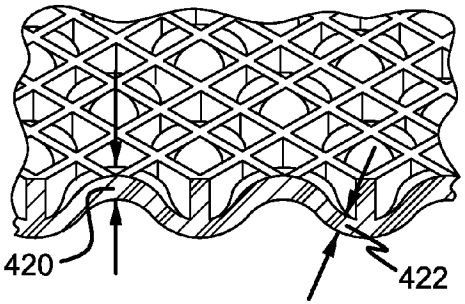
Figure 4C:
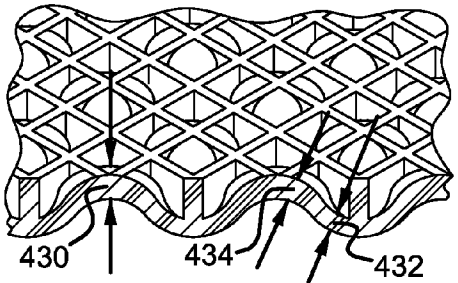

FIGS. 4A-4C shows an example surface with the polydome protuberances and ribbing included on both sides of the surface that may be a surface of component 112, 114, 116, 120, 122 or another engine component on the block, in the intake system, or in the exhaust system, for example. In the figures, exemplary surfaces show vertical slices through the horizontal plane along with the undulating cross-section created by the alternating pattern of the polydomes. The example surface of FIG. 4A is shown with a uniform cross-section while the example surfaces in FIGS. 4B and 4C have variable cross-sections wherein the thickness may be varied by, for instance, adjusting the shape of the polydome.

In FIG. 4A, the alternating nature of the polydomes is shown at 402 and 404. For example, polydome 402 may reside on the inner shell of an intake manifold and therefore project into the inner cavity. Based on the example relation shown, polydome 404 would alternatively reside on the outer shell and oppositely project from protuberances on the inner surface. The polydomes may be arranged within a row to have a binary 1-0-1-0 repeating pattern where the 1's represent, for instance, concave down (or convex) polydomes shown at 402 and 0's represent concave up polydomes shown at 404. However, the pattern is not limiting and other patterns have been contemplated. For example, in some instances the optimal pattern may be 1-0-0-1 or 1-1-0-0, etc.

FIG. 4A shows a grid of arrays of polydomal protuberances on the surface arranged at 90° with respect to one another and connected by cross-linking ribs 406. As described above with respect to FIG. 3B, the example surface shown again contains two types of rib intersections. However, because polydomes have an alternating 1-0-1-0 pattern, the ribs alternatively intersect cross-linking ribs at the peaks of convex domes (as shown at 402) and in the valleys of concave protuberances (as shown at 408). Protuberances are shown having the square arrangement wherein a central convex polydome is surrounded by and contiguous with four adjacent concave polydomes. The four adjacent concave polydomes are further surrounded by and contiguous with four convex polydomes in a repeating grid pattern of alternating structures. In the example shown, the polydomes are less than hemispherical, and intersect the planar surface at angles between 90 and 180°. However, other configurations may be used and the polydomes may be hemispherical or they may be more than hemispherical and intersect the planar surface at angles between 0 and 90° in some instances. As described above, polydomes have a circular cross-section in a plane parallel to the surface, but other examples could be used, for instance, elliptical or rectangular. Although not shown, the ribs may be optionally included on the bottom surface or they may be included on neither or both surfaces.

When alternating polydomes are included on both sides of a surface, the resulting cross-section may undulate as it traces the peaks and valleys of the protuberances. In FIG. 4A a uniform cross-section having a constant thickness is shown. At 410 the thickness in the region of a convex peak is identified. Although not shown, 410 may also represent the thickness in the region of a convex valley, for instance, near polydome 404. Conversely, the thickness in the transition region connecting a peak to a valley is depicted at 412. When 410 and 412 are substantially equal, the thickness is constant and the cross-section is uniform.

Alternatively, the cross-section may also vary along its length by changing, for instance, the thickness of the polydome peaks and valleys. FIG. 4B shows an example variable cross-section illustrating how the thickness may vary. A convex polydome having a thicker cross-section than the corresponding polydome shown in FIG. 4A is identified at 420. Although the thickness near this example peak has increased, it may also be reduced in some instances. In FIG. 4B, the thickness in the transition region 422 is substantially similar to the corresponding transition region shown at 412 in FIG. 4A. As such, 420 and 422 are substantially different and the cross-section varies cyclically or undulates along its edge. Although in this example, the peak (or valley) thickness 420 was adjusted compared to the uniform surface of FIG. 4A, in some embodiments, the thickness in the transition region 422 may also or alternatively be adjusted to vary the thickness of the surface. The non-uniform or variable cross-section described may provide advantages for noise reduction in certain parts of the frequency spectrum when designing engine parts.

FIG. 4C shows another example surface wherein the cross-section thickness is further varied by changing the polydome morphology or dome-shape. The polydome thickness of a peak (or valley) is again represented at 430 while the transition thickness between an adjacent peak and valley is represented at 432. In this example cross-section, the thickness of a polydome protuberance in the shoulder region connecting a peak (or valley) to the transition region is shown at 434. Adjusting the thickness at 434 may provide advantages for tuning the sound qualities by adjusting the shape of a protuberance. For example, increasing 434 may generate more block-like protuberances whose vibrational strength is optimal compared to the domes of FIGS. 4A and 4B. Alternatively, in some embodiments, a reduction in shoulder 434 may create a structure having more desirable qualities. For instance, the thickness may be reduced in order to keep the mass of an engine component constant.

Example engine system 100 may include numerous plastic components with smooth surfaces where polydome protuberances may be added, for example, the surfaces of component 112, 114, 116, 120, 122 or another engine component on the block, in the intake system, or in the exhaust system. In FIGS. 5-12 an example intake manifold is shown to illustrate polydome features in an example engine component. Because plastic pieces are commonly made by an injection mold process wherein a molten composite is injected into a mold cavity and allowed to solidify, structural features described in FIGS. 2A-4C form a continuous plastic material, wherein the protuberances are integrally molded into the surface. Structural features like those described in FIGS. 2A-4C may be included on an engine part. Once a new mold has been created and includes features identified during the design process, production of the engine part may be scaled up in the manufacturing process. During the manufacturing process, the time-to-freeze, which refers to the amount of time for the molten material injected to cool and solidify, may be an optimizable parameter for cost reduction. The time-to-freeze may depend on, for example, the amount of material injected into a mold cavity or the shapes of features present on the surface in addition to the composition of the material used.

Figure 5:
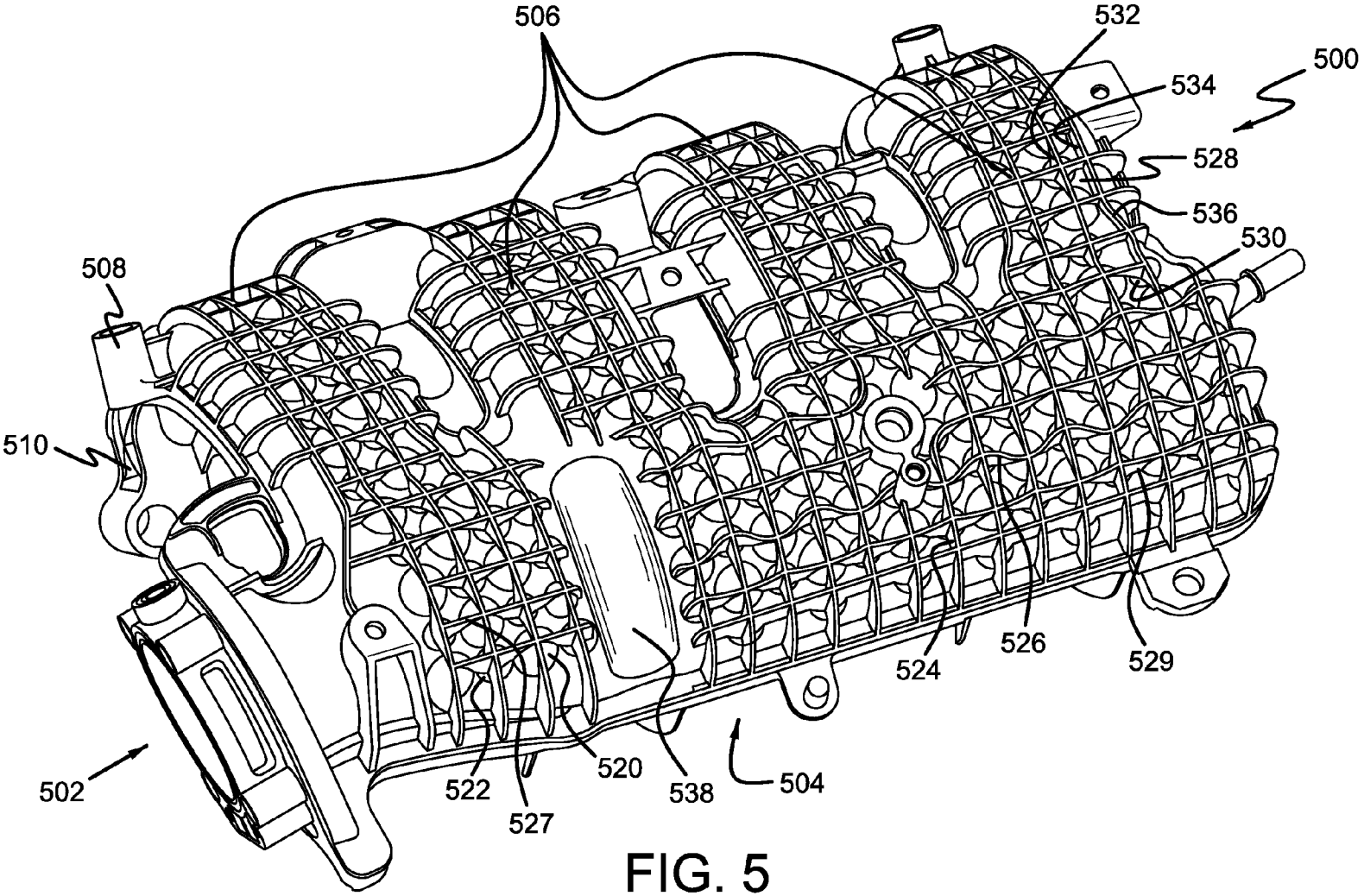
FIG. 5 shows an example intake manifold with polydome protuberances.

FIG. 5 shows example intake manifold 500. In an engine system, the intake manifold may be configured to supply air and/or fuel to the cylinders located in the engine block via the cylinder head. Air enters the intake manifold through intake passage 502, wherein the flow rate of the intake air can be controlled at least in part by a throttle control valve (not shown) located upstream of the manifold. As air flows into intake manifold 500 through passage 502, it enters the plenum shown at 504. The plenum is a chamber within the intake manifold. Once air enters the plenum, it may branch into multiple intake runners shown at 506, each intake runner fluidly communicating with one of the cylinders. For example, each cylinder may receive intake air from intake manifold 500 via the intake runner 506 coupled thereto. Further still, each intake runner may selectively communicate with a corresponding cylinder via one or more intake valves of that cylinder. In this way, the air intake system may communicate fluidly with cylinders via intake manifold 500. In the example manifold shown, the two plastic pieces are referred to as the upper manifold 508 and lower manifold 510. After each piece is manufactured separately by a casting process (e.g. either die cast or sand cast processes), the upper manifold 508 and lower manifold 510 are joined to form intake manifold 500.

Turning now to the example features described in FIGS. 2A-4C, intake manifold 500 is shown with polydome protuberances and ribbing to reinforce the structure and thereby reduce noise from vibrations within various frequency ranges in the engine system. For example, a polydome protuberance whose peak projects out from the outer shell of upper manifold 508 is shown at 520 and is herein referred to as a concave down or convex polydome. The protuberances are shown having a repeating 1-0-1-0 pattern described in FIGS. 4A-4C, wherein alternating protuberances in a row or column project in the same direction. Because the pattern alternates between peaks and valleys, between two successive convex protuberances is a concave up (or simply concave) protuberance whose peak projects into the inner cavity of the manifold. An example concave protuberance is shown at 522. As described in detail below, because added surface features may be included on a non-planar engine component, the grid-like pattern may conform to the shape of the engine part and therefore contain variations and irregularities in the repeating pattern. For instance, in the example manifold described herein, some polydomes have a substantially circular cross-section in a plane parallel to the surface, but other polydomes deviate from circular and instead have, for example, an elliptical cross-section.

At 524, the example manifold includes cross-linked ribbing that connects adjacent polydomes along the horizontal rows and vertical columns instead of along the diagonal as described with respect to the square polydome arrangement shown in FIG. 2B. Because the ribbing conforms to the contour of the surface, some irregularities are present. For example, the ribs coupled to runners 506 are substantially aligned in a grid-like structure as described in FIGS. 3A and 3B. However, example rib 526 coupled to plenum 504 undulates along the curved contour of the manifold.

Example pockets are identified at 528, 529 and 530 to illustrate how pockets in separate regions of the surface may vary in shape and size. For example, the enclosed area of pockets 528 and 529 appears smaller and substantially more rectangular than that of square pocket 530, which is larger and squarer due to the length of the surrounding ribs being substantially equal. Further, at 536, an example pocket is shown having a shape that deviates substantially from either a square or rectangle. Because the grid of interlocking ribs connects a central protuberance to directly adjacent protuberances instead of those located at the corner of a square arrangement, example square pocket 530 is comprised of a central planar region with a set of opposing corners having indentions due to concave polydomes and a set of opposing corners having domes due to convex polydomes. However, some pockets on the surface may be implemented in a different manner. For example, rectangular pocket 528 is shown having one indentation due to a concave polydome and one dome due to a convex polydome. This results from a difference in how the ribs are included on the surface. For example, rib 532 is shown connecting adjacent polydomes while example rib 534 connects polydomes in the region of plenum 504 but not in the region of runner 506. Ribs may also be disjointed and have different contours in separate regions of the surface. These may be due to, for example, intricate features of the surface. For example, the undulating rib at 526 is shown interrupted by the surface irregularity identified at 538 such that the rib on the opposite side of the gap shown at 527 is substantially straight.

Figure 6:
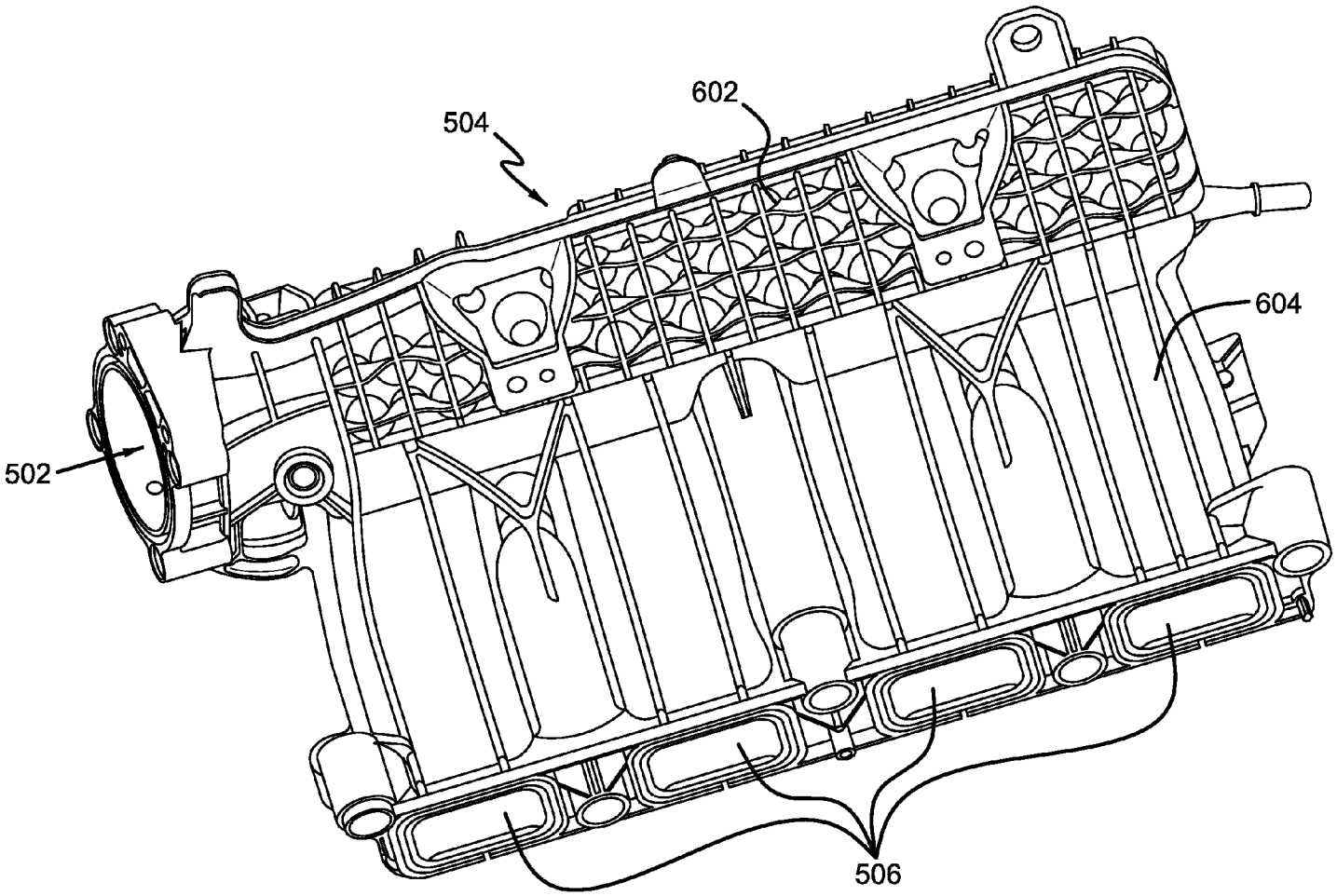
FIG. 6 shows the example lower intake manifold partially covered by polydome protuberances.

To further illustrate how the polydome protuberances may be implemented on an engine component, and with reference to FIG. 5, FIG. 6 shows a view of the lower manifold from underneath example intake manifold 500. The surface identified at 602 is coupled to plenum 504. In this exemplary region, the polydome protuberances have an alternating 1-0-1-0 polydome pattern reinforced by ribs. Conversely, the surface identified at 604, is coupled to the runners. In this exemplary region, a smooth surface is shown sparsely reinforced by ribs in one direction and with no polydome protuberances included. This example figure illustrates how the polydome structures may be partially present on the surface of an engine component.

Figure 7A:
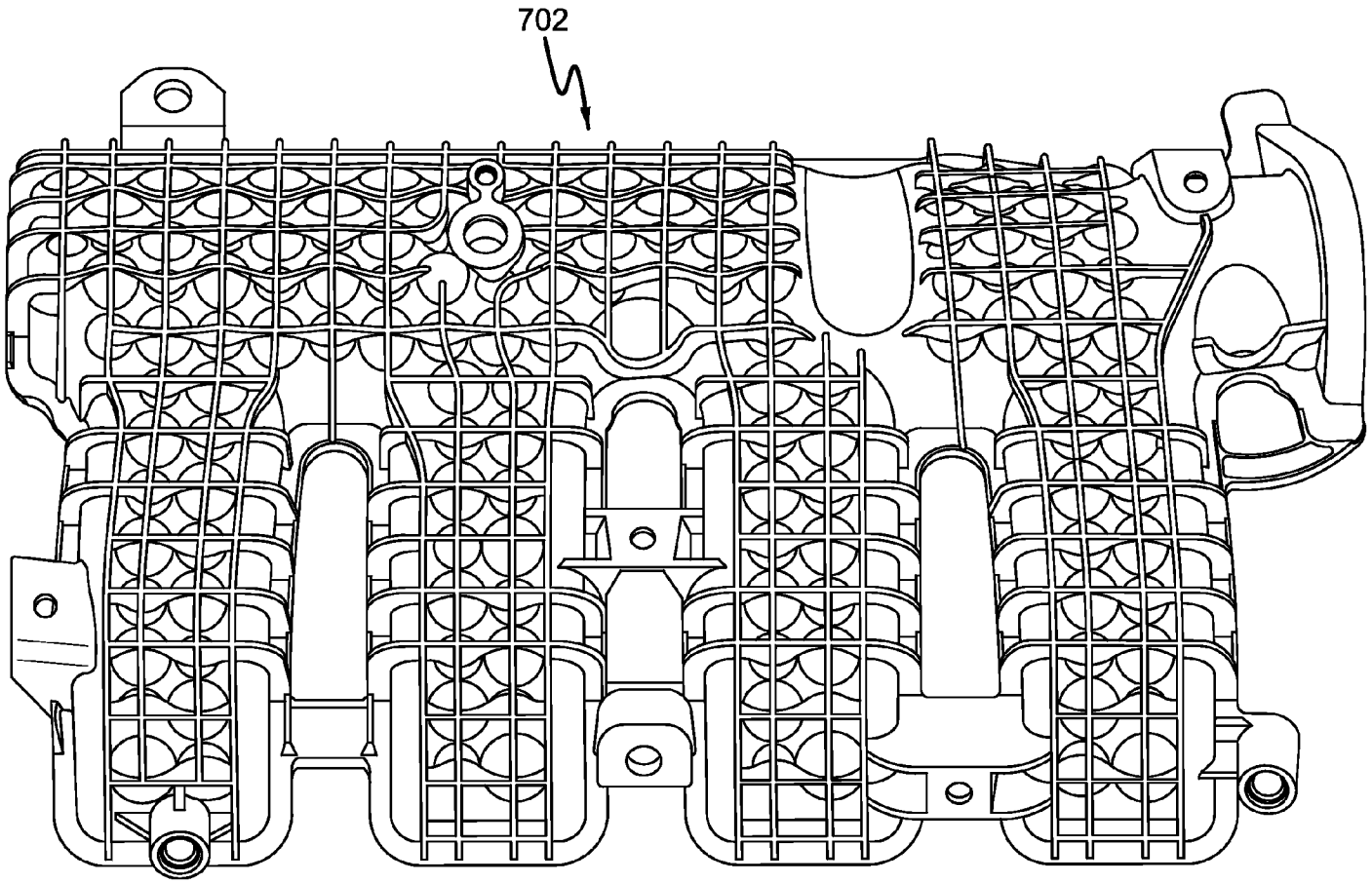
FIGS. 7A and 7B show the example upper intake manifold with asymmetric reinforcement by adding ribs to the outer surface and omitting them from the inner surface.
Figure 7B:
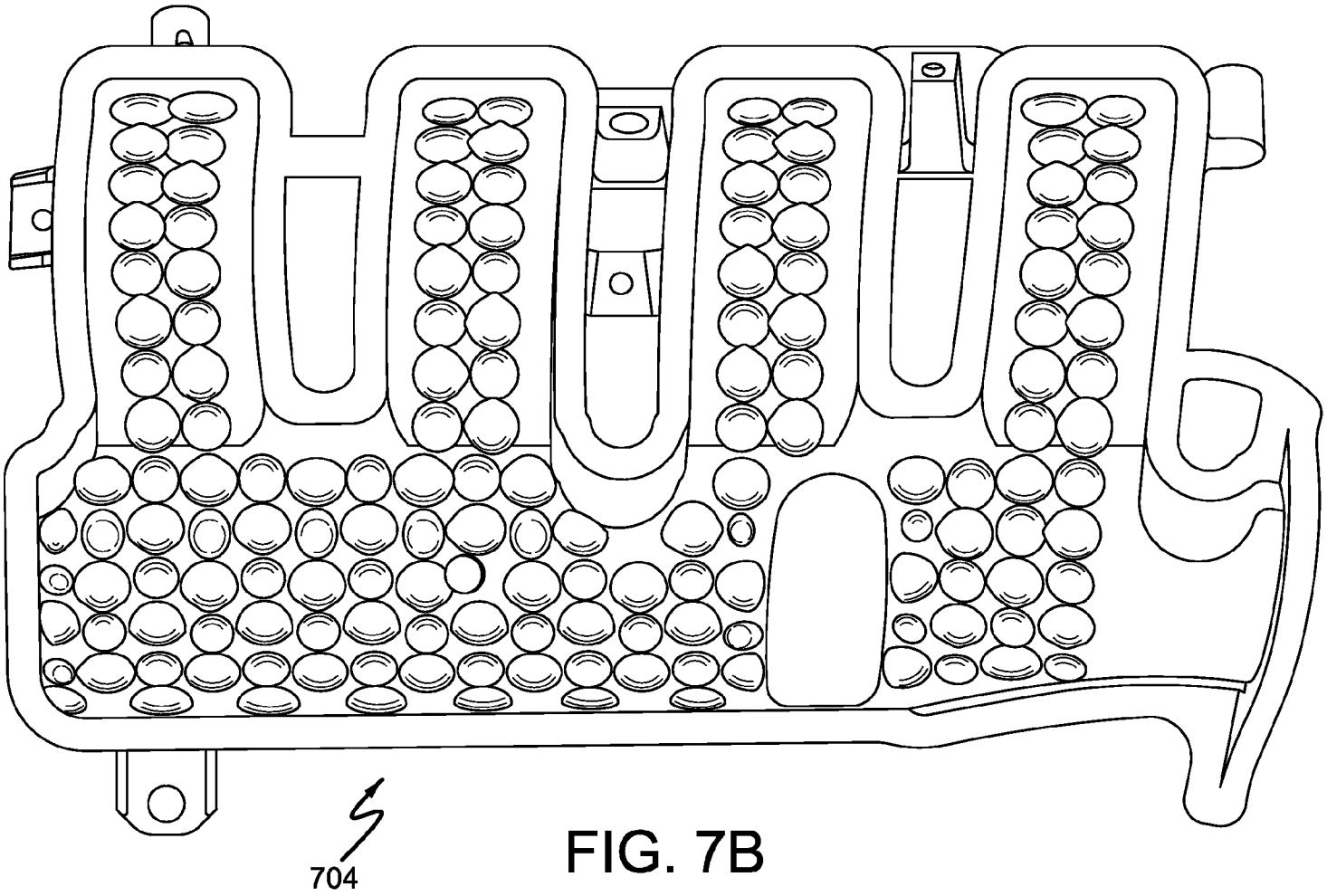

Polydome protuberances and ribs may also be asymmetrically included on an engine component, as shown in FIGS. 7A and 7B. There, two views of upper intake manifold 508 are shown to illustrate how example polydome features may include ribs on an outer surface but omit them on an inner surface. For example, FIG. 7A shows a view of the outer surface of the upper intake manifold at 702 where the outer surface includes polydomes reinforced by ribs covering substantially the entire surface. Conversely, FIG. 7B shows a view of the inner surface of the upper intake manifold. In this example surface, the repeating polydome protuberances are present on inner surface 704 but reinforcing ribs are omitted. Alternatively, the ribs may also be included on inner surface 704 or they may be omitted from outer surface 702, or they may be included on both or neither surfaces. Any combination of polydomes plus ribs may be implemented to strengthen the surface and thereby optimize the acoustic properties of the engine system.

Figure 8:
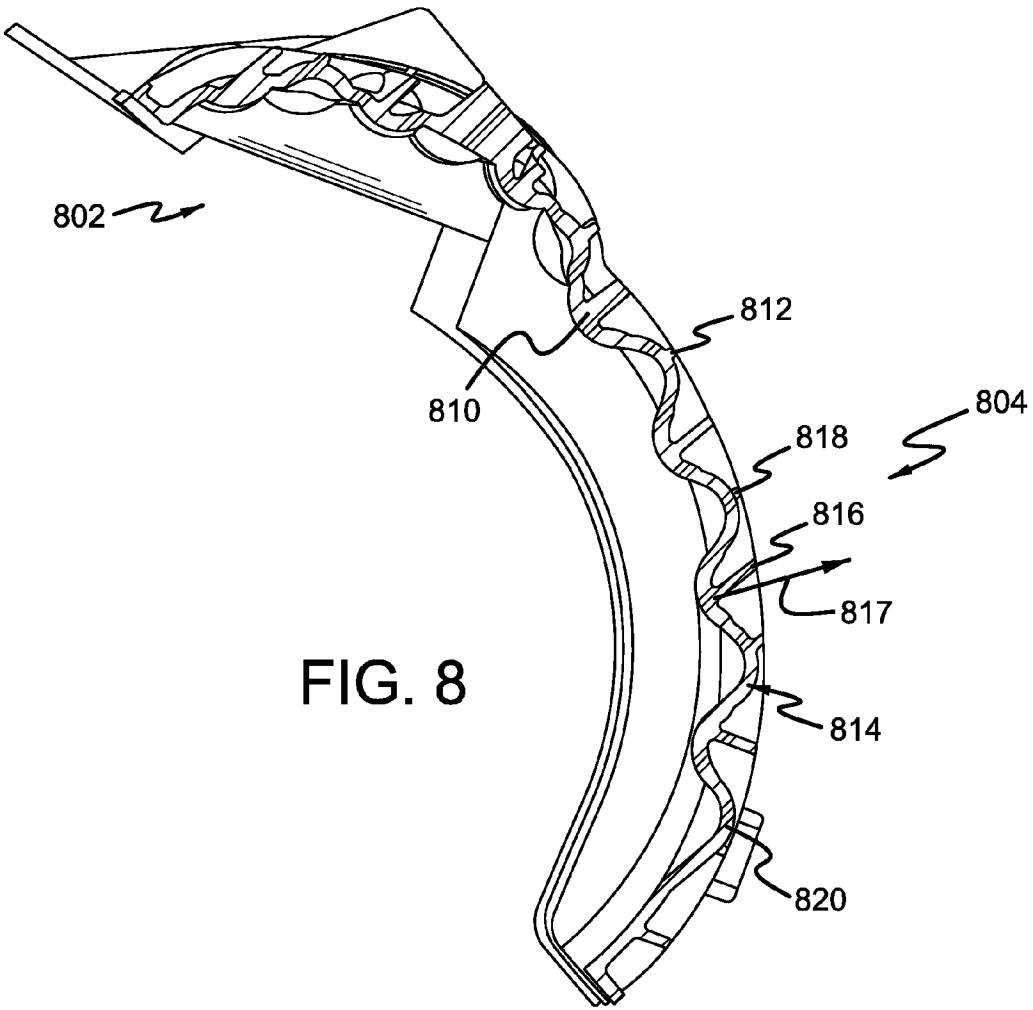
FIG. 8 shows an example vertical cross-section through the upper intake manifold and surface features therein.

In FIG. 8, a cross-section through the example upper manifold 508 is shown to illustrate possible polydomal variations within an engine component. For orientation and clarity, cavity 802 depicts plenum 504 of the upper intake manifold 508. Likewise, manifold runners 804 that deliver air to the cylinders of the engine block are also identified. An example concave protuberance whose peak projects into the manifold cavity is shown at 810. Conversely, 812 shows an example convex protuberance whose peak projects outward from the outer shell.

The vertical cross-section reveals the undulating surface of the alternating polydome pattern at 814. This example cross-section shows how polydomes may be included on and conform to the curved shape of an engine part. For example, the curvature of the undulating surface at 814 substantially matches the curvature of the runners. Alternatively, if the engine component contains substantially flat surfaces, the undulating cross-section would simply undulate with a linear curvature in a similar manner to the example surfaces shown in FIGS. 4A-4C.

At 816, an example rib is shown in the valley of a concave polydome. Although ribs may project orthogonally from a surface, 816 shows that in some instances they may not align normal to the surface. An example normal vector is included at 817 to exemplify how a rib may deviate from 90° relative to the surface at the valley of a concave polydome. These deviations may be in response to stresses imposed during the production process. Nonetheless, these ribs still add structural reinforcement that may benefit the sound quality of the engine system.

At 818, an example rib coupled to the peak of a polydome is shown. These ribs may also have a variable alignment and so project orthogonally from the surface in some instances, or deviate from 90° relative to the surface at the peak of a convex dome, as described above with respect to example rib 816. Deviations in rib alignment compared to the normal surface vector may result from stresses imposed by the injection mold process.

At 820, a convex feature is identified whose polydome shape deviates slightly from spherical. Deviations of shape may be intentional and systematic as described in, for example, FIG. 4C, or they may occur in response to stresses of the mold injection process. For instance, example polydome 820 may be broader than the other convex polydomes shown because of its location near the end of runner 804.

Figure 9:
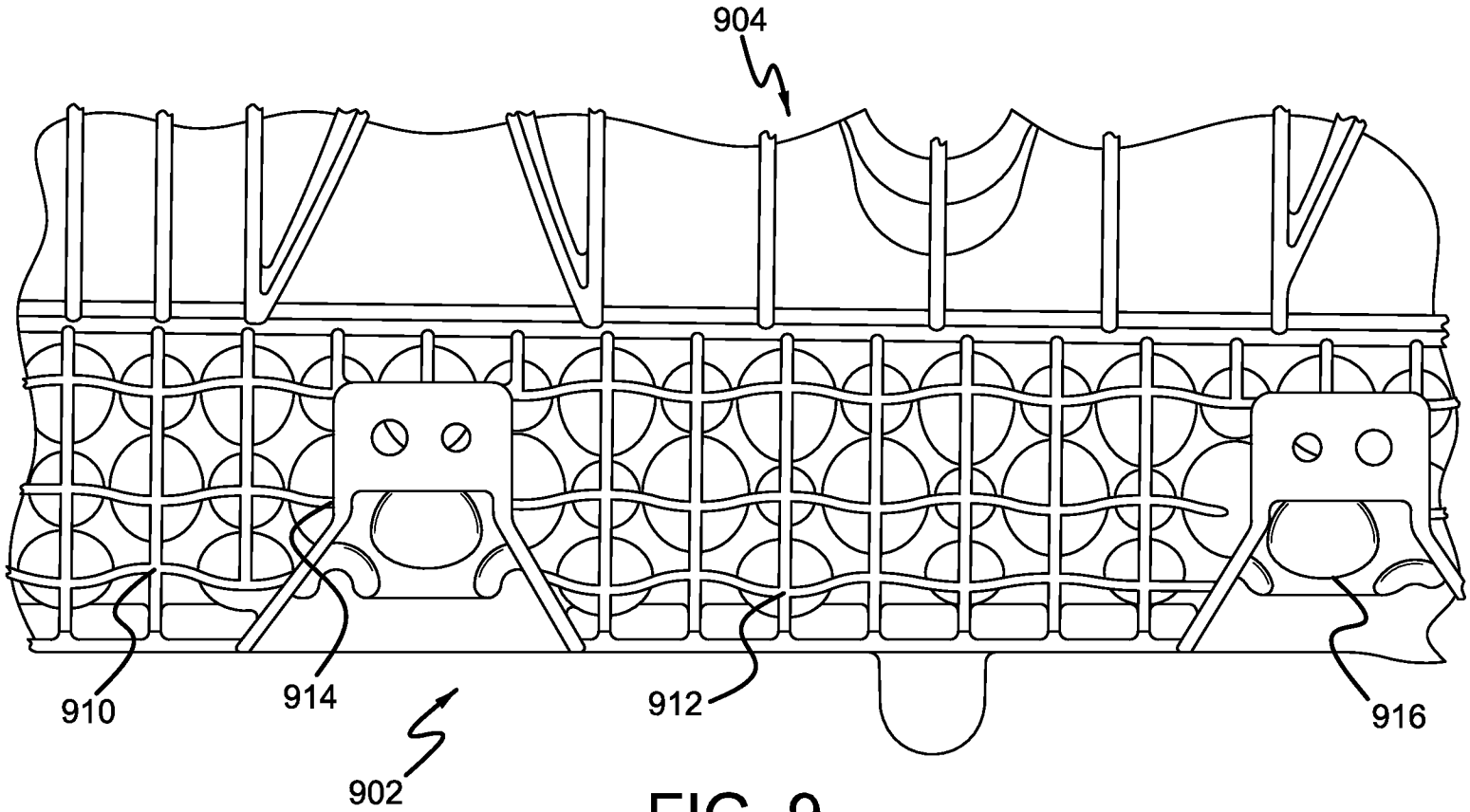
FIG. 9 shows a subsection of the example lower intake manifold and surface features therein.

Turning now to lower intake manifold 510, FIG. 9 shows further irregularities that may occur when including the polydome protuberances on an engine part. As described in FIG. 6, the lower manifold has two separate regions. The region at 902 encloses the plenum and includes polydome protuberances while the region associated with runners 904 does not include polydome protuberances and so has a smooth surface. The repeating structural features may be partially included in some regions or they may cover substantially the entire surface.

FIG. 9 shows further examples of the ribbing related to the shape of polydome features. For instance, an example ribbed structure reinforcing a concave protuberance is shown at 910. In this example cross-link, the horizontal rib has some apparent curvature that may be coupled to the shape of the concave protuberance. In this example structure, the ribs at 910 have an undulating contour that follows the shape of the protuberance in order to add structural support. In a similar manner, the ribs may follow the contour of a convex protuberance as shown at 912. As described with reference to the polydomes on a planar surface shown in FIG. 3B, the height of a polydome (e.g. 306) may be equal to the height of a rib (e.g. 314) at the apex of the dome, or the two heights may differ as shown here. Contoured ribs may be added as a means of minimizing the amount of material used during the manufacturing process.

Because engine parts may be formed of a complex shape, inclusion of polydome features may be constrained by surface irregularities. For instance, 914 shows an example polydome where the rib pattern is interrupted by a connecter plate present on the lower manifold. For example, this plate may allow manifold 500 to be mounted on engine block 110. In the example shown, although the repeating grid pattern is interrupted, it may continue on the other side of the connector plate. In some instances, however, while the repeating pattern is interrupted on the outer surface, it may not be interrupted on the inner surface. Such features and asymmetries may be accounted for in the design process wherein the optimal layout and distribution of polydomal features may be established. Example surface 916 shows that ribs may be optionally included in some regions that otherwise contain polydome protuberances.

Figure 10:
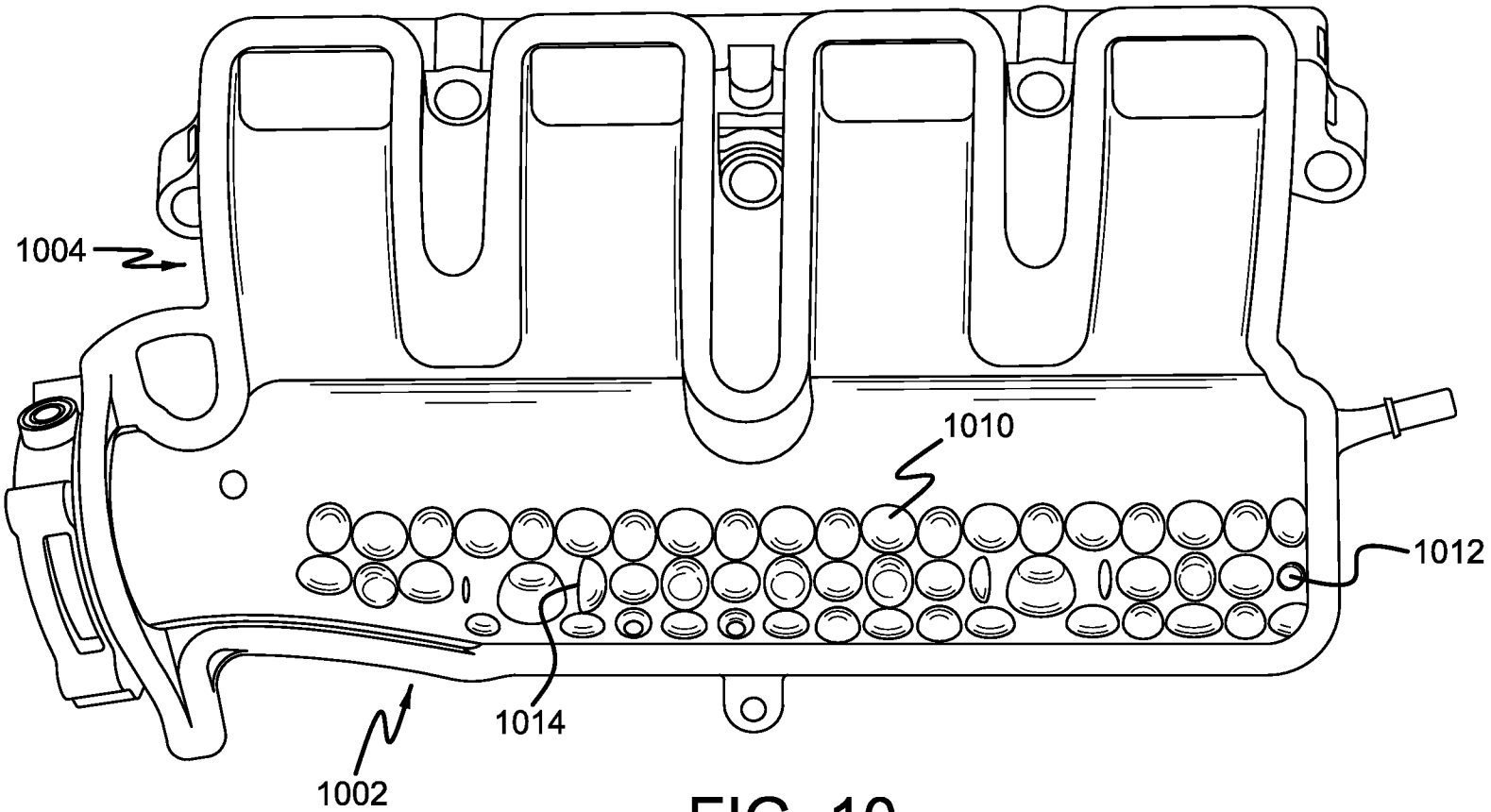
FIG. 10 shows the inner surface of the example lower manifold partially covered by polydome protuberances.

FIG. 10 shows the inner surface of lower manifold 510 wherein the cavity exists when shell 510 is attached to upper manifold 508. The cylindrical log shape of plenum 1002 is apparent in the figure. Intake passage 502 is shown to the left and air flows to the cylinders through the manifold runners shown at 1004. Although the inner cavity 1002 has polydomal features, no ribs are included on this example shell surface. As shown and described in FIG. 6, however, they may be optionally and asymmetrically included on the outer shell to increase the structural stiffness.

In FIG. 10, the repeating pattern of polydomes is included on the inner surface of the plenum. The example surface shown also includes protuberances whose shapes may vary as a result of being located on the curved contour of the shell. For example, a protuberance whose size deviates from the protuberances surrounding it is shown at 1012. Variable sizing may be optionally included as a part of the design process, or it may result from space constraints within an engine component.

At 1010, an example polydome whose cross-section in a plane parallel to the manifold surface is circular is shown for reference. Conversely, at 1014, a polydome whose cross-section in a plane parallel to the manifold surface is ellipsoidal is shown to exemplify how polydome shapes may vary within an engine part and how variations may lead to substantially different morphological features in some instances. A repeating grid of ellipsoids, or other shaped protuberances (e.g. cylinder), has also been contemplated, however, less than spherical protuberances are shown herein for simplicity.

Figure 11:
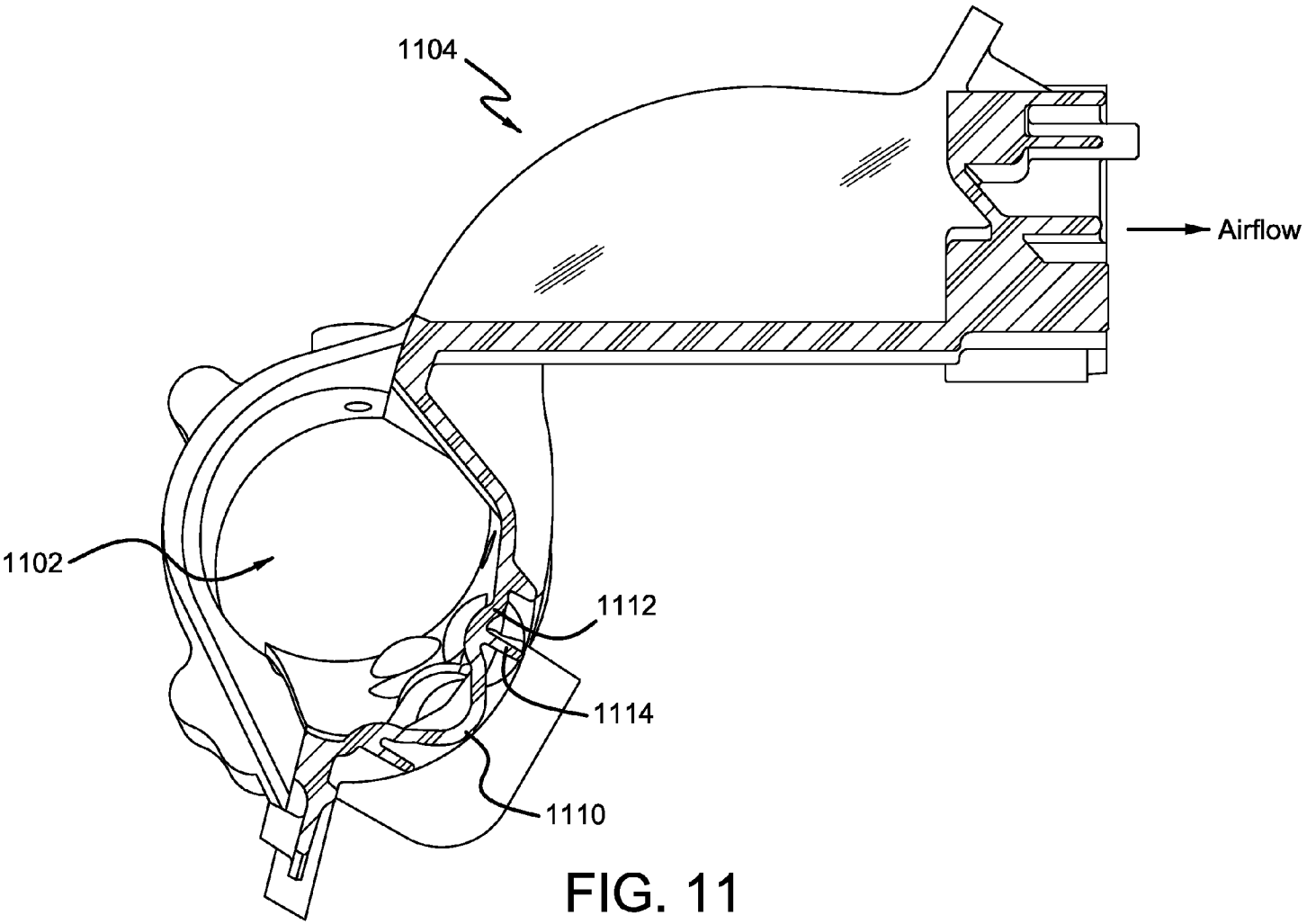
FIG. 11 shows a vertical cross-section through the lower intake manifold and example features therein.

FIG. 11 shows an example cross-section through lower manifold 510. In the figure, intake passage 1102 is visible as are manifold runners 1104 shown to the right. The direction of airflow through the runners has also been included for orientation and clarity.

In this example intake manifold, the complex shape illustrates how the undulating nature of the polydomes may extend over a small fraction of the total surface. Because the plenum surface containing example polydomes 1110 and 1112 is small relative to the size of the engine component, this view shows the protuberances may be included in an engine component containing both curved and flat regions. For example, polydome 1110 has a substantially full dome shape while polydome 1112 is a partial dome. In this example cross-section, the plenum surface connects to manifold runners through a transitory region that interrupts the undulating polydomal surface.

When lower manifold 510 is viewed end-on as depicted, the example row of polydomes extending back from polydome 1110 illustrates how the alternating and repeating pattern of polydomes (beyond 1110 the domes are shown) may have subtle variations in alignment so the rows are arranged substantially linearly. In this example, the polydomes generally align into a row and follow the contour of the inner plenum surface. However, in some instances, variations in polydome structure, either through surface morphologies, or inclusion of external features, e.g. the connector plate of lower intake manifold 510, or the general curvature of the engine component may affect the repeatability of the repeating polydome pattern. At 1114, an example rib is shown projecting substantially orthogonally out from an example polydome valley. Examples provided are not intended to limit the scope of the disclosure but simply highlight that complications may arise and affect how the repeating pattern of polydomes is implemented on an actual engine component.

Figure 12:
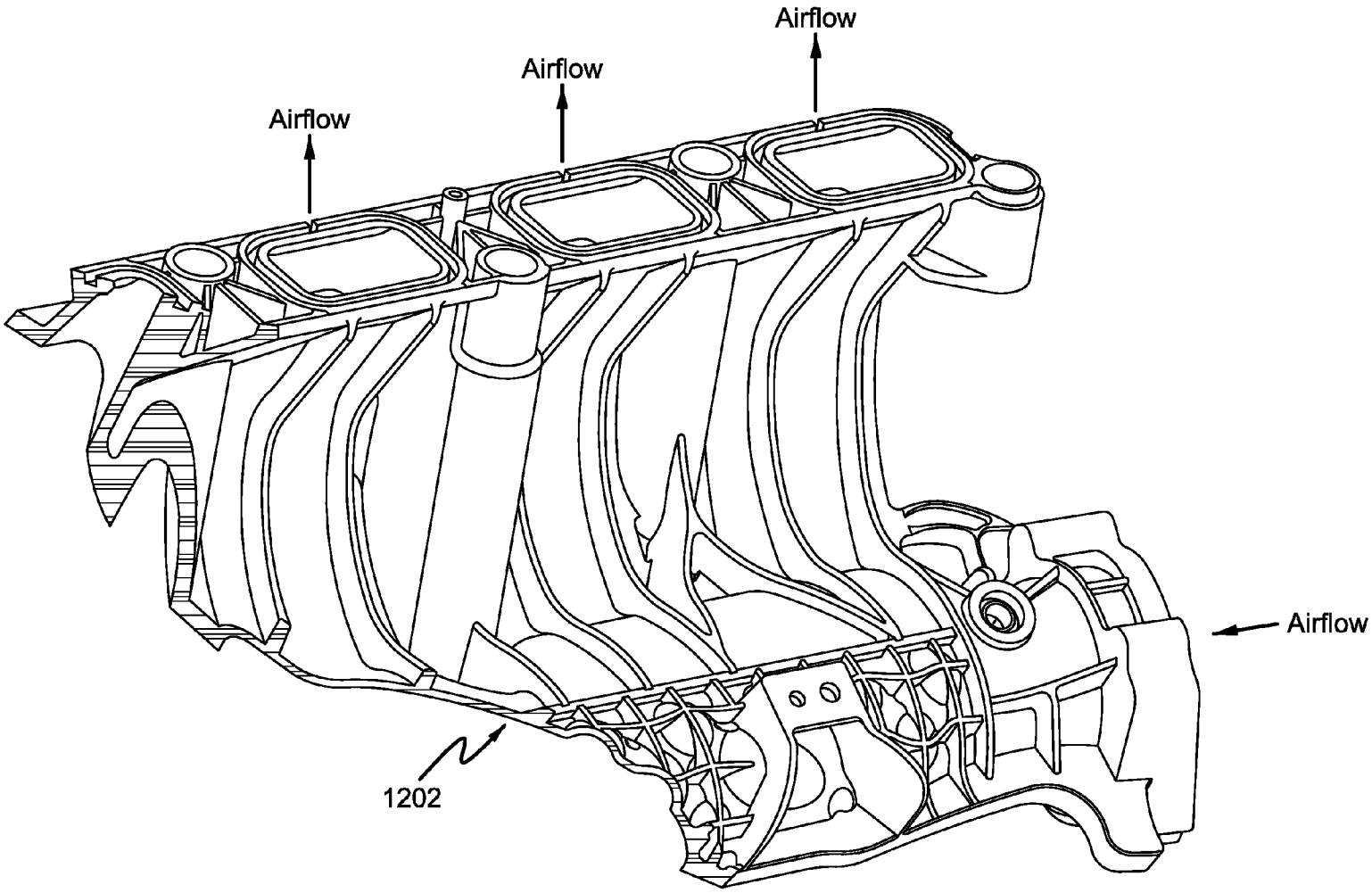
FIG. 12 shows an angular cross-section of the lower intake manifold and example features therein.

For comparison, FIG. 12 shows an example angular cross-section through the lower intake manifold. Contour 1202 further shows that the shape of an engine component may be complex and include smooth sections with ribs and other sections with polydome protuberances. Smooth regions with no polydomes may include partial ribbing on one side or the other or they may include ribs projecting out from both sides. Ribs may also be optionally cross-linked to other ribs or asymmetrically or symmetrically implemented, for example by having ribs projecting out from both surfaces of the engine component. Regions containing polydome protuberances may also optionally include ribbing and/or have an alternating 1-0-1-0 polydome pattern. Alternatively, the pattern may be, for example, 1-1-1-1 or 0-0-0-0, etc. The reinforced polydomes may be implemented symmetrically on both sides of an example surface, or asymmetrically on one side or the other. In some instances, the polydomes may be included on one side while the polydomes on the other side are reinforced by extra ribbing.

The subject matter of the present disclosure includes all novel and non-obvious combinations and sub-combinations of the various systems and configurations, and other features, functions, and/or properties disclosed herein.

The invention claimed is:

1. A device, comprising:

an engine component having a plastic outer shell with an outer surface including a plurality of polydomal protuberances projecting outward from the outer surface, projecting outward from the shell, and cooperating together to reduce noise and vibration, wherein the engine component has an inner surface opposite the outer surface and ribs are omitted from the inner surface opposite the outer surface; and ribs interconnecting with the polydomal protuberances on the outer surface, where planar outward surfaces of the ribs meet tangentially with an outer peak of the protuberances on the outer surface, wherein the polydomal protuberances have an alternating 1-0-1-0 pattern, the ribs alternatively intersecting cross-linking ribs at outer peaks of convex domes and in valleys of concave protuberances, wherein the protuberances have a square arrangement wherein a central convex polydome is surrounded by and contiguous with exactly four adjacent concave polydomes, the four adjacent concave polydomes further surrounded by and contiguous with exactly four convex polydomes in a repeating grid pattern of alternating structures.

2. The device of claim 1, wherein the polydomal protuberances are integrally molded into the outer surface, wherein the polydomal protuberances have a dome shape.

3. The device of claim 2, wherein the inner surface includes polydomal protuberances formed within a grid and oppositely projecting from the polydomal protuberances on the outer surface.

4. The device of claim 3, wherein material between the inner and outer surfaces has an undulating cross-section of uniform thickness.

5. The device of claim 4, wherein the polydomal protuberances are positioned in a repeating pattern to form a grid in a region of the device.

6. The device of claim 4, wherein a relative spacing between adjacent dome shaped structures is uniform.

7. The device of claim 4, wherein the protuberances extend along each of a plurality of intake manifold runners.

8. The device of claim 4, wherein the polydomal protuberances have a non-uniform wall thickness to reduce weight and production cycle time.

9. The device of claim 4, wherein the device is one or more of an engine cover, a cam cover, and an intake manifold, and wherein the outer surface is at least one of substantially planar and curved.

10. A composite intake manifold, comprising:

an outer shell with:

an inner surface including first polydomal surface protuberances, and an outer surface including second polydomal surface protuberances projecting outward from the outer shell, away from the inner surface, and arranged in a repeating pattern, the first and second polydomal surface protuberances oppositely projecting from each other, wherein ribs are perpendicularly arranged through peaks of the protuberances, where outward surfaces of the ribs meet tangentially with a peak of the protuberances, wherein the ribs are perpendicular with a cross-linked arrangement including two types of rib intersections, a first type of rib intersection including the ribs intersecting in a gap between polydomal protuberances and a second type of rib intersection meeting tangentially with an outer peak of the protuberance, with a central polydomal protuberance connected to protuberances directly adjacent to it through ribs so the cross-linked arrangement aligns with arrays of an x-y grid pattern, with rib intersections distributed uniformly throughout the grid, and ribs perpendicular to one another forming a repeating x-y grid pattern across the manifold including multiple intake runners of the manifold.

11. The composite intake manifold of claim 10, wherein the outer shell has a cross-section with a uniform thickness.

12. The composite intake manifold of claim 11, further comprising a grid pattern of ribs interconnecting with the polydomal surface protuberances.

13. The composite intake manifold of claim 11, wherein a diameter of the polydomal surface protuberances varies across the region.

14. The composite intake manifold of claim 10, wherein the intake manifold includes a plurality of separate sections including intake runners, each runner communicating with one cylinder of an engine, each of the sections including polydomal surface protuberances, wherein each of a plurality of runners includes the polydomal surface protuberances.

15. The composite intake manifold of claim 10, wherein the oppositely projecting protuberances are alternately arranged in a grid pattern.

* * * * *